US005631837A

United States Patent [19]

Fukumura

[11] Patent Number: 5,631,837

[45] Date of Patent: May 20, 1997

[54] OUTPUT CONTROL SYSTEM FOR INTERNAL COMBUSTION ENGINE

[75] Inventor: Tomohiro Fukumura, Yokosuka, Japan

[73] Assignee: Nissan Motor Co., Ltd., Yokohama, Japan

[21] Appl. No.: 283,867

[22] Filed: Aug. 1, 1994

[30] Foreign Application Priority Data

Aug. 2, 1993 [JP] Japan ..... 5-191333

[51] Int. Cl.[6] ..... F02D 17/02

[52] U.S. Cl. ..... 364/431.03

[58] Field of Search ..... 364/431.03, 431.07, 364/431.08, 565; 123/416, 417, 418, 419, 422, 426

[56] References Cited

U.S. PATENT DOCUMENTS

| | | | |
|---|---|---|---|
| 4,063,538 | 12/1977 | Powell et al. | 123/117 R |
| 4,429,365 | 1/1984 | Luckman et al. | 364/431.08 |
| 4,519,038 | 5/1985 | Matsui et al. | 364/431.03 |
| 4,809,660 | 3/1989 | Marsh et al. | 123/417 |
| 4,893,244 | 1/1990 | Tang et al. | 364/431.03 |
| 4,899,282 | 2/1990 | Holmes | 364/431.08 |
| 4,931,940 | 6/1990 | Ogawa et al. | 364/431.03 |
| 4,989,448 | 2/1991 | Fukui et al. | 73/116 |
| 5,041,980 | 8/1991 | Maddock et al. | 364/431.03 |
| 5,047,943 | 9/1991 | Takahata et al. | 364/431.03 |
| 5,150,300 | 9/1992 | Danno et al. | 364/431.03 |
| 5,235,696 | 8/1993 | Schaff | 395/425 |
| 5,422,811 | 6/1995 | Togai | 364/431.05 |
| 5,426,585 | 6/1995 | Stepper et al. | 364/424.03 |
| 5,481,461 | 1/1996 | Miyamoto et al. | 364/431.01 |

FOREIGN PATENT DOCUMENTS

| | | |
|---|---|---|
| 58-8436 | 1/1983 | Japan . |
| 1-130018 | 5/1989 | Japan . |
| 4-298731 | 10/1992 | Japan . |
| 6-146944 | 5/1994 | Japan . |

*Primary Examiner*—Kevin J. Teska
*Assistant Examiner*—Stephen J. Walder, Jr.
*Attorney, Agent, or Firm*—Lowe, Price, LeBlanc & Becker

[57] ABSTRACT

An output control system for an internal combustion engine includes an engine output lowering magnitude command component outputting a command indicative of a magnitude to lower the engine output, an engine operating condition judgement component responsive to an engine output control command to make a judgement at every combustion timing on whether a cylinder scheduled for next combustion is or is not to be placed into a resting state, a cylinder resting performing component for disabling combustion at the combustion timing for which resting is determined by the judgement component, and a storage for storing judgment results made by the judgement portion during a predetermined number of immediately preceding combustion timings. The judgement portion compares a command output by the engine output lowering magnitude command component and past judgement results stored in the storage portion, and makes a present judgement as to whether the cylinder scheduled for the next combustion is or is not to be placed in resting condition on the basis of a result of the comparison.

16 Claims, 13 Drawing Sheets

FIG_8

| Mode | 0 → 1 → | | | | | |
|---|---|---|---|---|---|---|
| Combustioning cylinder | #3 | #4 | #1 | #2 | #3 | #4 |
| Operating condition judgement | ○ | × | ○ | ○ | ○ | × |

FIG_9

| Mode | 4 → | 3 → | 2 → | 1 → | 0 | |
|---|---|---|---|---|---|---|
| Combustioning cylinder | #3 | #4 | #1 | #2 | #3 | #4 |
| Operating condition judgement | × | × | ○ | ○ | ○ | ○ |

FIG_10

| Mode | 0 → | 1 → | 2 → | 3 → | 4 → | |
|---|---|---|---|---|---|---|
| Combustioning cylinder | #4 | #1 | #2 | #3 | #4 | #1 |
| Operating condition judgement | ○ | × | ○ | × | × | × |

FIG. 12

| Mode | 0 → 3 | | | | | | | | | | | |
|---|---|---|---|---|---|---|---|---|---|---|---|---|
| Combustioning cylinder | #4 | #1 | #2 | #3 | #4 | #1 | #2 | #3 | #4 | #1 | #2 | #3 |
| FLAG f | 0 | 0 | 1 | 0 | 0 | 0 | 1 | 0 | 0 | 0 | 1 | 0 |
| FLAG g | 0 | 0 | 0 | 1 | 0 | 0 | 0 | 0 | 0 | 0 | 0 | 1 |
| Operating condition judgement | ○ | ○ | × | × | ○ | ○ | × | ○ | ○ | ○ | × | × |

FIG_13

| Mode | 0 → | | 1 → | | | |
|---|---|---|---|---|---|---|
| Combustioning cylinder | #4 | #1 | #2 | #3 | #4 | #1 |
| Virtual cylinder number | #4 | #1 | #1 | #2 | #3 | #4 |
| Operating condition judgement | ○ | ○ | × | ○ | ○ | ○ |

FIG_14

| Mode | 4 → | 3 → | 2 → | 1 → | 0 | |
|---|---|---|---|---|---|---|
| Combustioning cylinder | #3 | #4 | #1 | #2 | #3 | #4 |
| Operating condition judgement | × | × | × | × | ○ | ○ |

Wasting period

FIG_15

| Mode | 0 → | 1 → | 2 → | 3 → | 4 → | |
|---|---|---|---|---|---|---|
| Combustioning cylinder | #4 | #1 | #2 | #3 | #4 | #1 |
| Operating condition judgement | ○ | × | ○ | ○ | ○ | × |

Wasting period

FIG_16
PRIOR ART

| Mode | Number of F/C cylinder | F/C judgement for each cylinder | | | |
|---|---|---|---|---|---|
| | | #1 | #2 | #3 | #4 |
| 0 | 0 | ○ | ○ | ○ | ○ |
| 1 | 1 | × | ○ | ○ | ○ |
| 2 | 2 | × | × | ○ | ○ |
| 3 | 3 | × | × | × | ○ |
| 4 | 4 | × | × | × | × |

FIG_17A
PRIOR ART

| Mode | 0 → | | 1 → | | | |
|---|---|---|---|---|---|---|
| Combustioning cylinder | #3 | #4 | #1 | #2 | #3 | #4 |
| Operating condition judgement | ○ | ○ | × | ○ | ○ | ○ |

FIG_17B
PRIOR ART

| Mode | 0 → | | 1 → | | | |
|---|---|---|---|---|---|---|
| Combustioning cylinder | #4 | #1 | #2 | #3 | #4 | #1 |
| Operating condition judgement | ○ | ○ | ○ | ○ | ○ | × |

Wasting period

OUTPUT CONTROL SYSTEM FOR INTERNAL COMBUSTION ENGINE

BACKGROUND OF THE INVENTION

1. Field of the Invention

The present invention relates to an output control system for an internal combustion engine.

2. Description of the Related Art

In order to lower an output torque of an internal combustion engine for controlling an engine output, there is a method to placing a part of or all of engine cylinders resting by performing fuel cut-off (F/C) or ignition cut-off.

In this case, in order to control the lowering magnitude of the engine output torque in stepwise fashion, the number of the engine cylinders placed in resting state is to be controlled.

As such a control system, a fixed cylinder resting type engine output control system has been known in the technologies disclosed in Japanese Unexamined Patent Publications Nos. SHO 58-8436 and HEI 1-130018.

In this case, the cylinders to be placed in the resting state is preliminarily determined for respective modes depending upon the lowering magnitude of the engine output torque. For instance, in the case of 4-cylinder engine, a map illustrated in FIG. 13 can be used. In FIG. 13, #1, #2, #3 and #4 represent the 1st cylinder to 4th cylinders. Also, o represent fuel supply timing and x represent fuel cut-off timing, i.e. F/C. It should be appreciated that o and x will be used in the same meanings in the following description.

However, the above-mentioned engine output control system is not satisfactory in a response to initiation of the control.

For instance, as shown in FIG. 14(A), when a command for mode 1, in which F/C is to be effected for one cylinder and when the combustion stroke of the cylinder to be effected the F/C is scheduled at a timing immediately after occurrence of the command, the F/C for #1 cylinder can be effected. However, as shown in FIG. 14(B), if the combustion timing of the cylinder to be effected the F/C is immediately before the occurrence of the command (in other words, when the cylinder combustioned immediately before is commanded as the cylinder to be rested immediately after combustion), the period (corresponding to two turns of rotation of the crankshaft, i.e. one engine cycle) up to the next occurrence of combustion becomes wasted. In such case, the response characteristics in the engine output control becomes bad.

SUMMARY OF THE INVENTION

Therefore, it is an object of the present invention is to provide an engine output control system which can improve a response characteristics in initiation of an engine output control.

Another object of the invention is to provide an engine output control system which can control an engine output in restriction of an engine output with taking past judgement whether engine output restriction is to be effected or not, for adapting the engine output control to an engine operating condition and whereby improve the response characteristics.

According to the first aspect of the invention, an output control system for an internal combustion engine comprises:

engine output lowering magnitude commanding means for outputting an engine output control command indicative of a magnitude to lower the engine output;

engine operating condition judgement means responsive to the engine output control command from the engine output lowering magnitude commanding means and active at every combustion timing, for making judgement whether the cylinder scheduled for next combustion is to be placed into the resting state or not;

cylinder resting performing means for disabling combustion at the combustion timing for which resting is determined by the engine operating condition judgement means;

storage means for storing the results of judgement made by the engine operating condition judgement means for predetermined number of immediately preceding combustion timings, the engine operating condition judgement means comparing an engine output lowering magnitude commanded by the engine output control command output by the engine output lowering magnitude commanding means and the results of past judgements stored in the storage means to make judgement whether the cylinder scheduled for next combustion is to be placed in resting condition or not on the basis of the result of comparison.

According to the second aspect of the invention, an output control system for an internal combustion engine having a plurality of cylinders comprises:

engine output lowering magnitude commanding means for outputting an engine output control command indicative of a magnitude to lower the output the engine having a plurality of cylinders;

calculation means for calculating number of cylinders to be placed in resting condition on the basis of the commanded engine output lowering magnitude;

engine operating condition judgement means for making judgement whether the cylinder scheduled for next combustion is to be placed into the resting state or not on the basis of the number of cylinders to be placed in resting condition calculated by the calculation means;

cylinder resting performing means for disabling combustion at the combustion timing for which resting is determined by the engine operating condition judgement means;

storage means for storing the results of judgement made by the engine operating condition judgement means for predetermined number of immediately preceding combustion timings, which predetermined number is at least a value subtracting one from the number of the cylinders, the engine operating condition judgement means comparing the number of cylinders to be placed in resting condition calculated by the calculation means and the number of cylinders placed in resting condition in preceding combustion timings, to make judgement whether the cylinder scheduled for next combustion is to be placed in resting condition or not on the basis of the result of comparison.

According to the third aspect of the invention, an output control system for a multi-cylinder internal combustion engine comprises:

first means for providing an engine output control command indicative of an engine output restriction magnitude;

second means active at every combustion timing, for computing the engine output restriction magnitude achieved up to the current combustion timing and making decision whether the cylinder schedules for combustion at the current combustion timing is to be placed in resting condition on the basis of the achieved engine output restriction magnitude and the engine output restriction magnitude commanded by the engine output control command;

third means for monitoring engine output restricting operation and storing data indicative of the achieved engine output restriction magnitude, the third means updating the data whenever the second means makes decision; and fourth means for controlling combustion of the cylinder scheduled for combustion at the current combustion timing depending upon the decision made by the second means.

According to the fourth aspect of the invention, a traction control system comprises:

first means for monitoring wheel slippage at driving wheel on the basis of wheel speeds at respective wheels;

second means for providing an engine output control command indicative of an engine output restriction magnitude;

third means active at every combustion timing, for computing the engine output restriction magnitude achieved up to the current combustion timing and making decision whether the cylinder schedules for combustion at the current combustion timing is to be placed in resting condition on the basis of the achieved engine output restriction magnitude and the engine output restriction magnitude commanded by the engine output control command;

fourth means for monitoring engine output restricting operation and storing data indicative of the achieved engine output restriction magnitude, the fourth means updating the data whenever the second means makes decision; and fifth means for controlling combustion of the cylinder scheduled for combustion at the current combustion timing depending upon the decision made by the third means.

BRIEF DESCRIPTION OF THE DRAWINGS

FIG. 8 is an illustration showing one example of a timing chart showing a content of control, in which the timing chart upon initiation of fuel cut-off control is illustrated;

FIG. 9 is a timing chart showing one example of the case where the mode is stepped down;

FIG. 10 is a timing chart showing one example of the case where the mode is stepped up;

FIG. 12 is a timing chart showing one example of the content of control to be performed by the embodiment of FIG. 11;

FIG. 13 is an illustration showing a basic concept principle of a resting cylinder slide type engine output control;

FIG. 14 is an illustration showing a manner of control upon resumption in the resting cylinder slide type engine output control concept;

FIG. 15 is an illustration showing another process in the resting cylinder slide type engine output control concept;

FIG. 16 is an illustration showing an example of a setting map for a resting cylinder fixed type engine output control system in the prior art; and FIGS. 17(A) and 17(B) are illustration showing the content of control in the prior art.

DESCRIPTION OF THE PREFERRED EMBODIMENT

Figure 1:
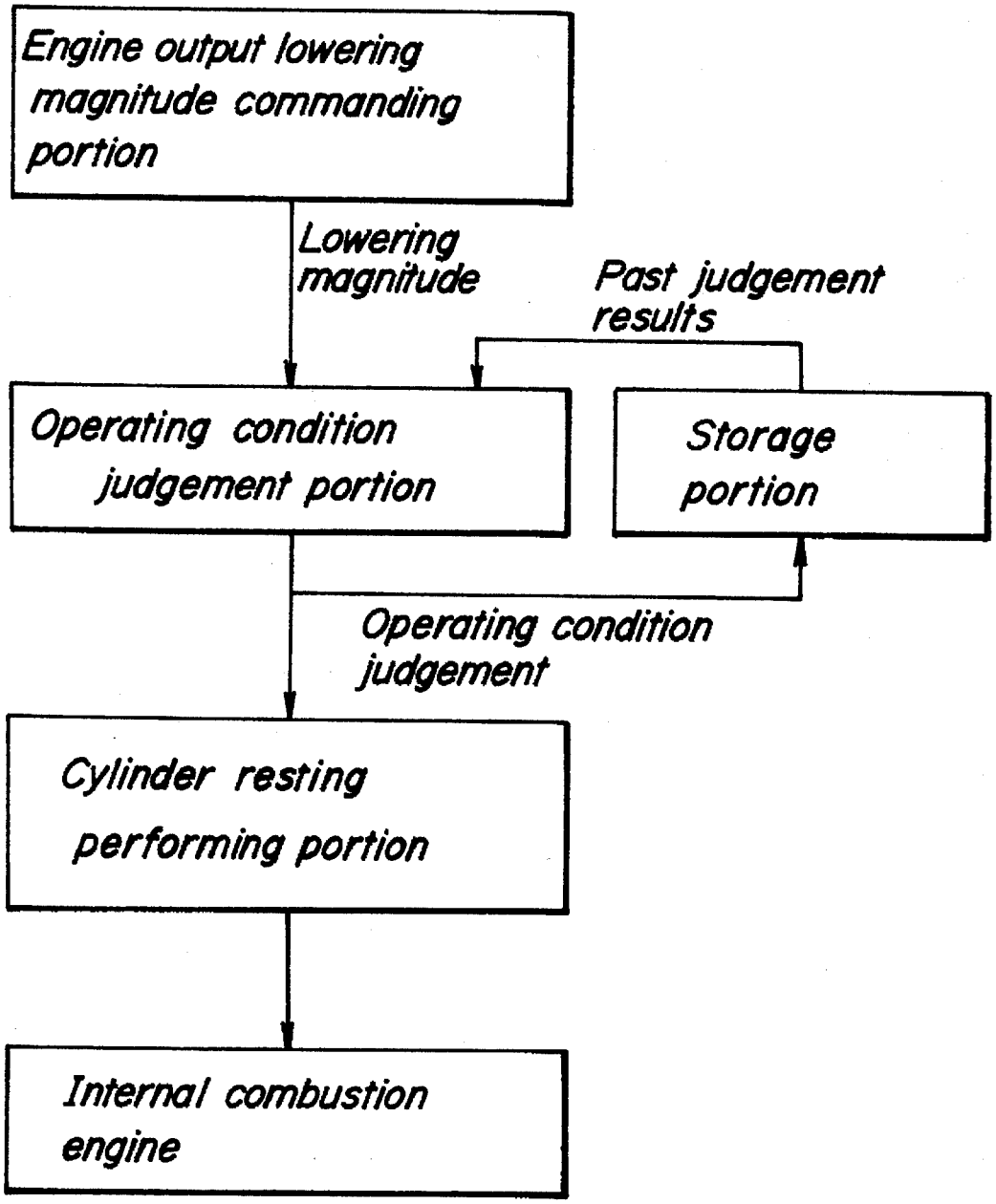
FIG. 1 is a conceptual illustration showing an output control system for an internal combustion engine according to the present invention.

The preferred embodiments of an output control system for an internal combustion engine according to the present invention will be discussed hereinafter in detail with reference to FIGS. 1 to 15. In the following description, numerous specific details are set forth in order to provide a thorough understanding of the present invention. It will be obvious, however, to those skilled in the art that the present invention may be practiced without these specific details. In other instances, well-known structures are not shown in detail in order not to unnecessary obscure the present invention.

The present invention basically employs a principle of variable cylinder assignment in determination of the cylinder to be resting in effecting an engine output control. The principle is illustrated in FIG. 13. For engine cylinders, virtual cylinder numbers are assigned in addition to the physical or normal cylinder numbers. Basically, in the active state of the engine output control, the virtual cylinder numbers are re-assigned depending upon a timing, at which a demand for the engine output control occurs, and the engine revolution cycle. Namely, at the occurrence of demand for the engine output control, the virtual cylinder number is re-assigned so that the cylinder causing combustion immediately after initiation of the engine output control is assigned as a virtual #1 cylinder. Employing this virtual cylinder number, the map illustrated in FIG. 16 can be used for determining the cylinder to be rested depending upon a control mode. Therefore, in the shown case of FIG. 13, assuming that the engine output control is initiated after combustion of the cylinder which is physically assigned as #1 cylinder for engine output control in mode 1 for placing the #1 cylinder in resting state, #2 cylinder which is scheduled to cause combustion immediately after initiation of the engine output control is assigned as virtual #1 cylinder. As can be seen from FIG. 16, since F/C is scheduled for #1 cylinder in the mode 1, F/C can be effected for the physical #2 cylinder virtually assigned as #1 cylinder. With this process, the F/C can be instantly performed upon initiation of the engine output control operation. The principle, the hardware construction and process of control realizing the foregoing has been disclosed in commonly owned Japanese Patent Application No. HEI 4-298731. The disclosure of the above-identified commonly owned co-pending application is herein incorporated by reference. The type of the engine output control system according to the present invention will be hereinafter referred to as "resting cylinder slide type engine output control system".

As can be appreciated from the discussion given hereabove, the resting cylinder slide type engine output control system according to the invention can minimize or eliminate wasting period after initiation of the engine output control, and whereby can improve the response characteristics in initiation of the engine output control, since F/C can be effected immediately after initiation of the control.

The present invention is directed to a further improvement of the above-mentioned resting cylinder slide type engine output control system. FIG. 1 shows the fundamental and conceptual construction of the engine output control system according to the present invention. As shown in FIG. 1, the engine output control system according to the present invention includes an engine output lowering magnitude commanding portion which outputs an engine output control command indicative of a magnitude to lower the engine output, an engine operating condition judgement portion responsive to the engine output control command from the engine output lowering magnitude commanding portion and active at every combustion timing to make judgement whether the cylinder scheduled for next combustion is to be placed into the resting state or not, a cylinder resting performing portion for disabling combustion at the combustion timing for which resting is determined by the engine operating condition judgement portion, a storage portion for storing the results of judgement made by the engine operating condition judgement portion for predetermined number of immediately preceding combustion timings. The engine operating condition judgement portion compares an engine output lowering magnitude commanded by the engine output control command output by the engine output lowering magnitude commanding portion and the results of past judgements stored in the storage portion to make judgement whether the cylinder scheduled for next combustion is to be placed in resting condition or not on the basis of the result of comparison.

Away from the prior proposed resting cylinder slide type engine output control system, the present invention takes a principle for determining whether engine output control is to be effected or not irrespective of the cylinder number instead of employing the virtual cylinder number. The principle of the present invention should become clear from the following discussion given with reference to FIG. 2.

Figure 2:
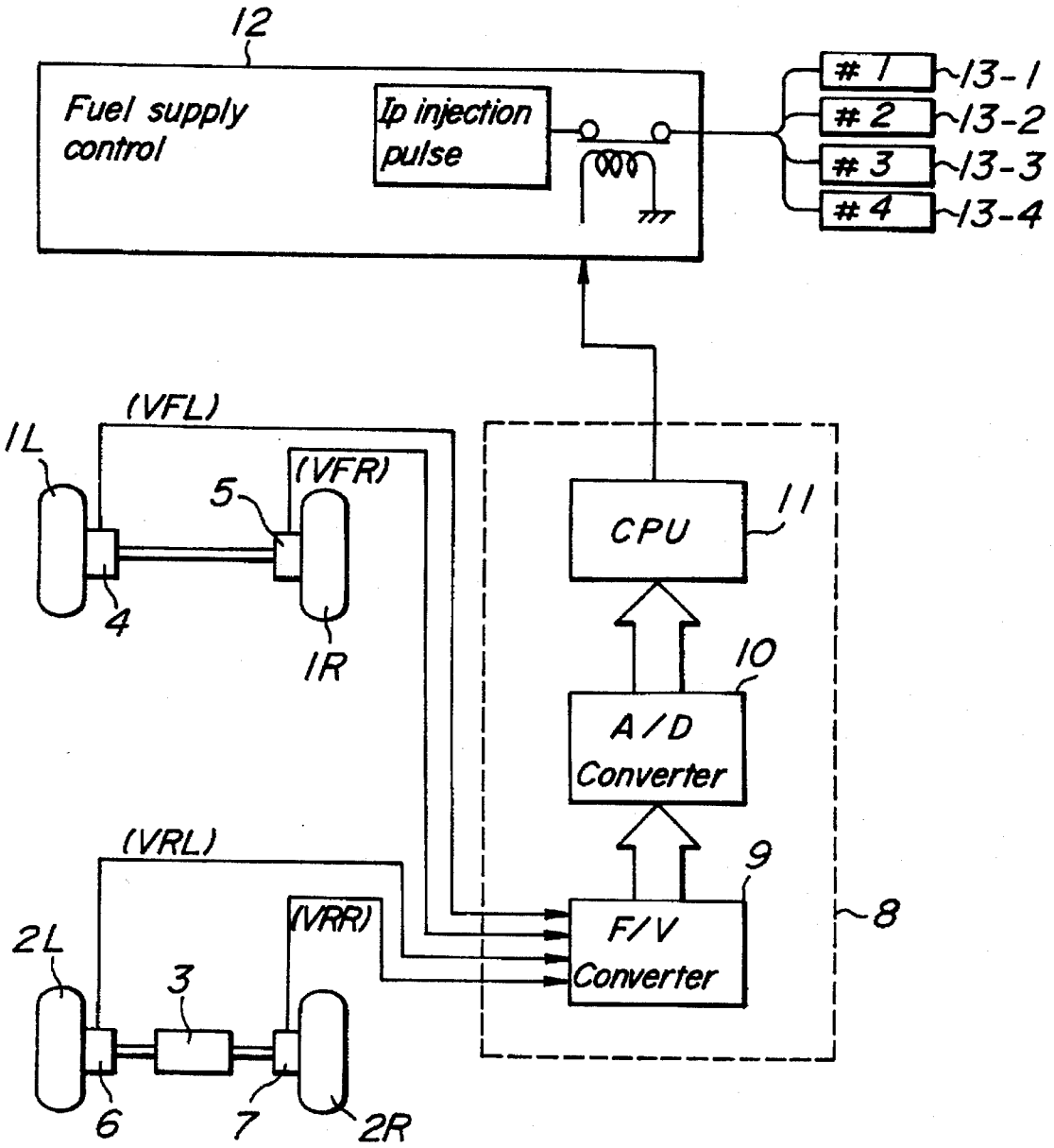
FIG. 2 is a block diagram showing one embodiment of the engine output control system according to the invention.

FIG. 2 shows one embodiment of an output control system for an internal combustion engine according to the present invention. It should be noted that the shown embodiment of the engine output control system is applied to a traction control system which prevents driving wheels from causing wheel spin. In the shown embodiment, adjustment of a driving torque is performed by way of fuel cut-off (F/C) for selected engine cylinder or cylinders.

In FIG. 1, 1L and 1R denote front-left and front-right wheels of an automotive vehicle, and 2L and 2R denote rear-left and rear-right wheels. 3 denotes an internal combustion engine as a prime mover of the vehicle. It should be noted that the shown embodiment is applied for a 4-cylinder internal combustion engine and the vehicle has a FR (front engine-rear wheel drive) type power train layout for driving rear-left and rear-right wheels 2L and 2R. For respective wheels 1L, 1R, 2L and 2R, wheel speed sensors 4, 5, 6 and 7 are provided.

It should be appreciated that while the shown embodiment of the engine output control system is applied for the vehicle of FR type power train layout, it is equally applicable for the vehicles of any type of power train layout, such as FF (front engine-front wheel drive) type, 4WD (four-wheel drive) type and so forth.

The wheel speed sensors 4 to 7 detect rotation speeds of respectively corresponding wheels and generate pulse signals having frequencies respectively corresponding to the rotation speed of the wheels as wheel speed signals VFL, VFR, VRF and VRR. The wheel speed signals VFL, VFR, VRL and VRR are input to a frequency-to-voltage (F/V) converter 9 in a control unit 8. The control unit 8 includes the F/V converter, an analog-to-digital (A/D) converter 10 and a CPU 11 forming a microcomputer. The F/V converter 9 performs frequency-to-voltage conversion for the wheel speed signals VFL, VFR, VRL and FRR to input corresponding wheel speed indicative voltage signals to the A/D converter 10. The A/D converter 10 converts the wheel speed indicative voltage signal into digital wheel speed data and input to the CPU 11.

The CPU 11 detects wheel slippage on the basis of the wheel speed data VFL, VFR, VRL and VRR and performs an engine output lowering control for controlling a driving force for preventing the wheels from causing wheel spin. In the shown embodiment, an output torque of the engine 3 is adjusted in order to adjust driving torque distributed to the driving wheels 2L and 2R. In order to lower the engine output torque, the shown embodiment performs a fuel supply control for effecting a fuel cut-off so that a part of or all of engine cylinders are placed in resting condition.

The fuel cut-off can be achieved by outputting a fuel cut-off signal from the CPU 11 to a fuel supply control device 12 which performs a fuel injection. In practice, fuel injection pulses Ip output to respective ones of the cylinders (#1, #2, #3 and #4) 13-4~13-4 of the engine 3 and selectively shut off for the cylinder or cylinders, for which F/C is to be effected. By shutting off the fuel injection pulse, fuel cut-off can be performed. By placing one or more selected cylinders in the resting state, the engine output torque can be lowered. In the alternative, the fuel cut-off can also be performed by resetting a fuel injection period Ti derived by the CPU 11 to zero on the basis of the results of execution of the programs of the shown embodiment, illustrated in FIGS. 4 to 7, when fuel injection period Ti is calculated corresponding to a fuel injection amount according to a fuel injection amount calculation program executed in synchronism with an engine revolution cycle (combustion cycle).

In the fuel cut-off control for adjustment of the driving force, the CPU 11 calculates a wheel slippage and derives necessary lowering magnitude of the drive torque on the basis of the wheel slippage. On the basis of the derived necessary drive torque lowering magnitude, the CPU 11 makes a judgement whether the cylinder scheduled for next combustion is to be rested at every combustion timing of the 4-cylinder engine. When judgement is made that the cylinder is to be placed in the resting condition, the fuel cut-off is performed. In conjunction therewith, the CPU 11 operates to store the result of judgement of the operating condition for a predetermined number of recent judgments. Upon judgement of the operating condition, the stored past judgement is taken into account so that the currently obtained drive torque lowering magnitude and the stored past judgement are compared to make judgement of the operating condition to perform the fuel cut-off operation.

Figure 3:
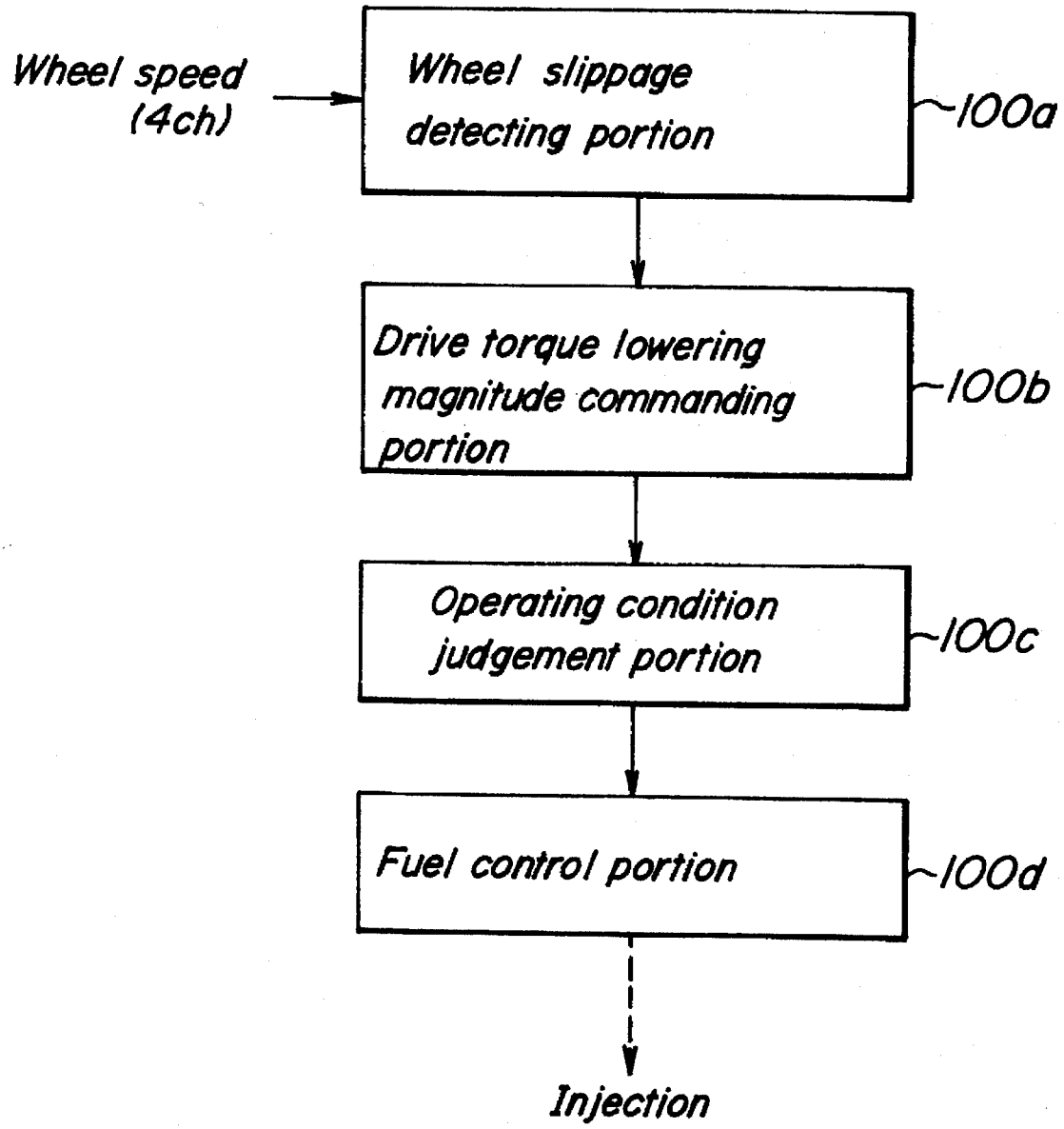
FIG. 3 is a diagrammatic illustration showing the shown embodiment of the engine output control system in a form of function blocks.

FIG. 3 is a block diagram illustrating control functions to be performed by the shown embodiment of the engine output control system of the present invention, in a form of a diagram of function blocks. In FIG. 3, the engine output control system includes a wheel slippage detecting portion 100*a*, a drive torque lowering magnitude commanding portion 100*b* (output lowering magnitude commanding portion), an operating condition judgement portion 100*c* (engine operating condition judgement portion) and a fuel control portion 100*d* (cylinder resting performing portion). The wheel slippage detecting portion 100*a* detects wheel slippage on the basis of the wheel speeds. Depending upon the detected wheel slippage magnitude derived by the wheel slippage detecting portion 100*a*, the drive torque lowering magnitude commanding portion 100*b* determines a drive torque lowering magnitude to command to the operating condition judgment portion 100*c*.

The operating condition judgement portion 100*c* is responsive to the command to perform judgement whether the cylinder is to be rested per every occurrence of combustion in each engine cylinder. The operating condition judgement portion 100*c* includes a storage portion for storing a predetermined number of most recent results of judgements. The operating condition judgement portion 100*c* compares the currently commanded engine output lowering amount and the past result of judgements stored in the storage portion to perform operating condition judgement for current combustion.

The fuel control portion 100*d* effects fuel cut-off for the cylinder or cylinders, for which the judgment is made to place them into the resting state. In the shown embodiment, the operating condition judgement portion 100*c* and the fuel control portion 100*d* employ a F/C flag indicative of a fuel cut-off state and a fuel supply state. The F/C flag is also used for storing the results of the operating condition judgement.

FIGS. 4 to 7 show an example of a concrete control programs to be practically executed and corresponding to respective portions 100*a* to 100*d* set forth above.

It should be noted that, in the following examples of the programs, the shown embodiment is applied for only split cylinder control being controlled in control of the number of resting cylinders for stepwise controlling the engine output torque lowering magnitude. Accordingly, here, alternate operation, in which engine driving and resting are repeated per every combustion will not be performed. Namely, the number of steps to effect the engine output torque control (=number of modes excluding a mode 0 where the all cylinders become subject to fuel supply), is preferred to be consistent with the number of cylinders. In other words, the value of the mode number and the number of the resting cylinders are the same.

Figure 4:
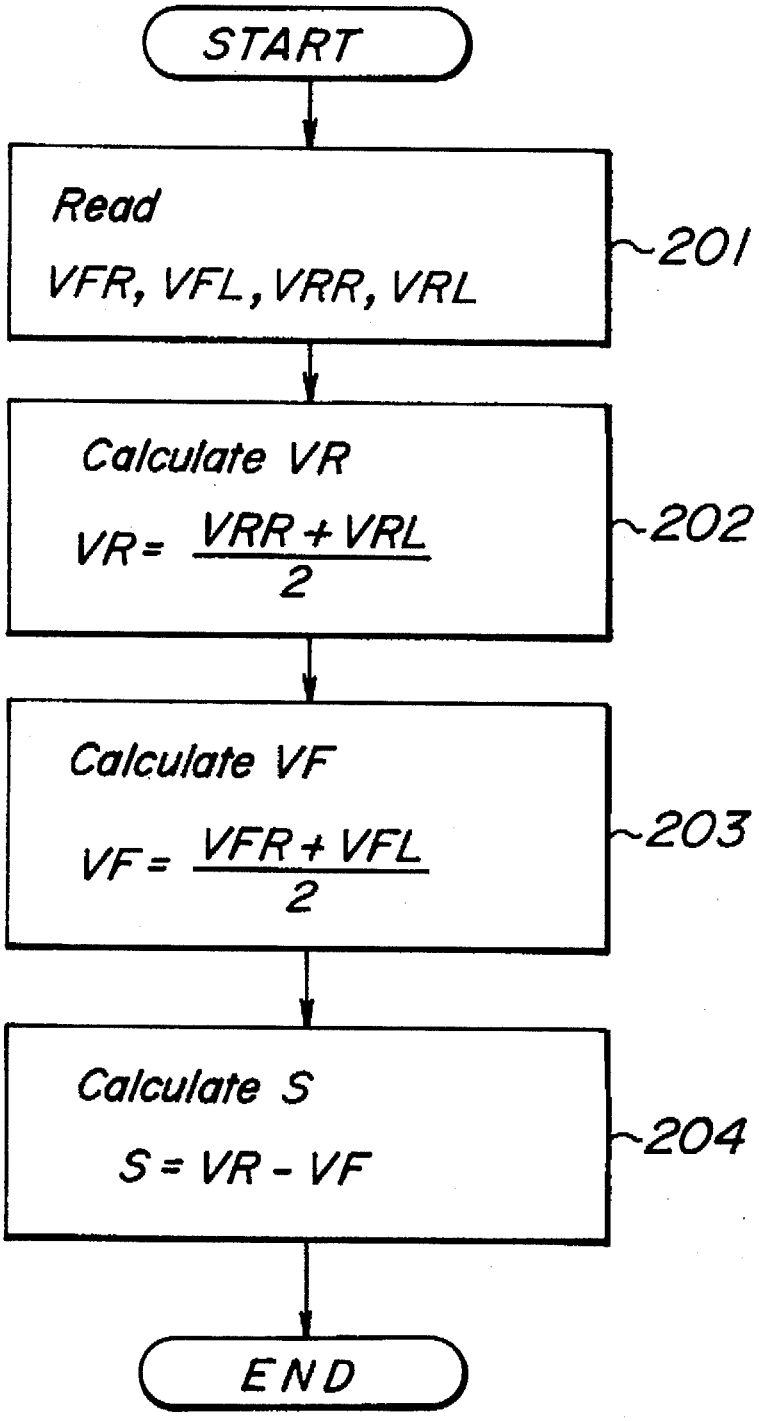
FIG. 4 is a flowchart showing a part of a control program to be executed by a control unit in the shown embodiment for computing a slippage.

FIG. 4 is a flowchart of a control program for realizing the process corresponding to the content of the wheel slippage detecting portion. The shown program and the program shown in FIG. 5 may be periodically executed at constant intervals.

In FIG. 4, at a step 201, the wheel speeds VFL, VFR, VRL and VRR (4 ch) of the wheel speed indicative signals are read out. Then, an average speed VR of the rear two wheels 2RL and 2RR and an average speed VL of the front two wheels 1FL and 1FR are calculated respectively through the following equations (steps 202 and 203).

$$VR=(VRR+VRL)/2 \quad (1)$$

$$VF=(VFR \text{ and } VFL)/2 \quad (2)$$

Then, at a step 204, the wheel slippage S is calculated as the difference between the average speed VR of the rear wheels 2RL and 2RR and the average speed VF of the front wheels 1FL and 1FR.

$$S=VR-VF \quad (3)$$

Figure 5:
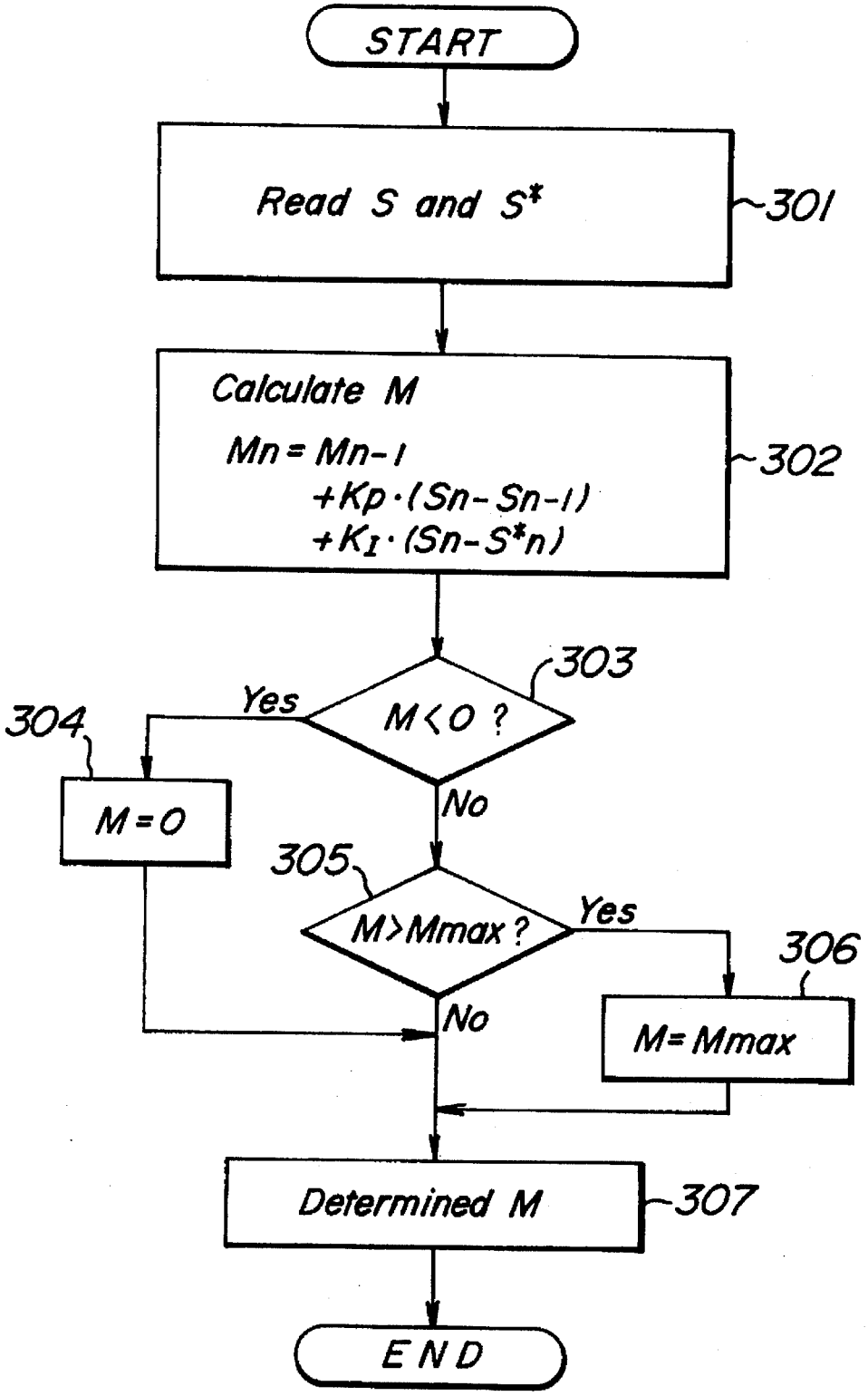
FIG. 5 is a flowchart showing one example of a control program for determining a mode for commanding a drive torque lowering magnitude, to be executed by the control unit in the shown embodiment.

FIG. 5 is a flowchart showing a control program which realizes a function corresponding to the drive torque lowering commanding portion. The routine shown in FIG. 5 is executed after execution of the control program of FIG. 5.

Initially, at a step 301, the foregoing wheel slippage S and a wheel slippage reference value S* to be used in the drive force control are read out. Next, at a step 302, a mode value M indicative of the drive torque lowering magnitude is calculated from the following equation.

$$M_n=M_{n-1}+K_P\cdot(S_n-S_{n-1})+K_I\cdot(S_n-S^*_n) \quad (4)$$

wherein $M_n$ and $M_{n-1}$ are respectively currently calculated value and precedingly calculated value of the mode value, $S_n$, $S_{n-1}$ and $S^*_n$ are respectively current wheel slippage, preceding wheel slippage and currently adapted value of the slip reference value to be compared with the slip reference value, $K_P$ and $K_I$ are respectively gains.

By comparing the derived wheel slippage S and the slippage reference value S* in the manner set forth above, the mode M indicative of the lowering magnitude of the drive torque is determined.

Judgement of M<0, setting of M=0, judgement of M>Mmax and setting of M=Mmax at the steps 303 to 306 are a limiter process for the mode value M derived at a step 302. Through these processes, the mode value M is limited within a range of minimum value 0 and the maximum value Mmax corresponding to the number of the available modes. It should be appreciated that, in the shown embodiment, the maximum mode value is 4.

Figure 6:
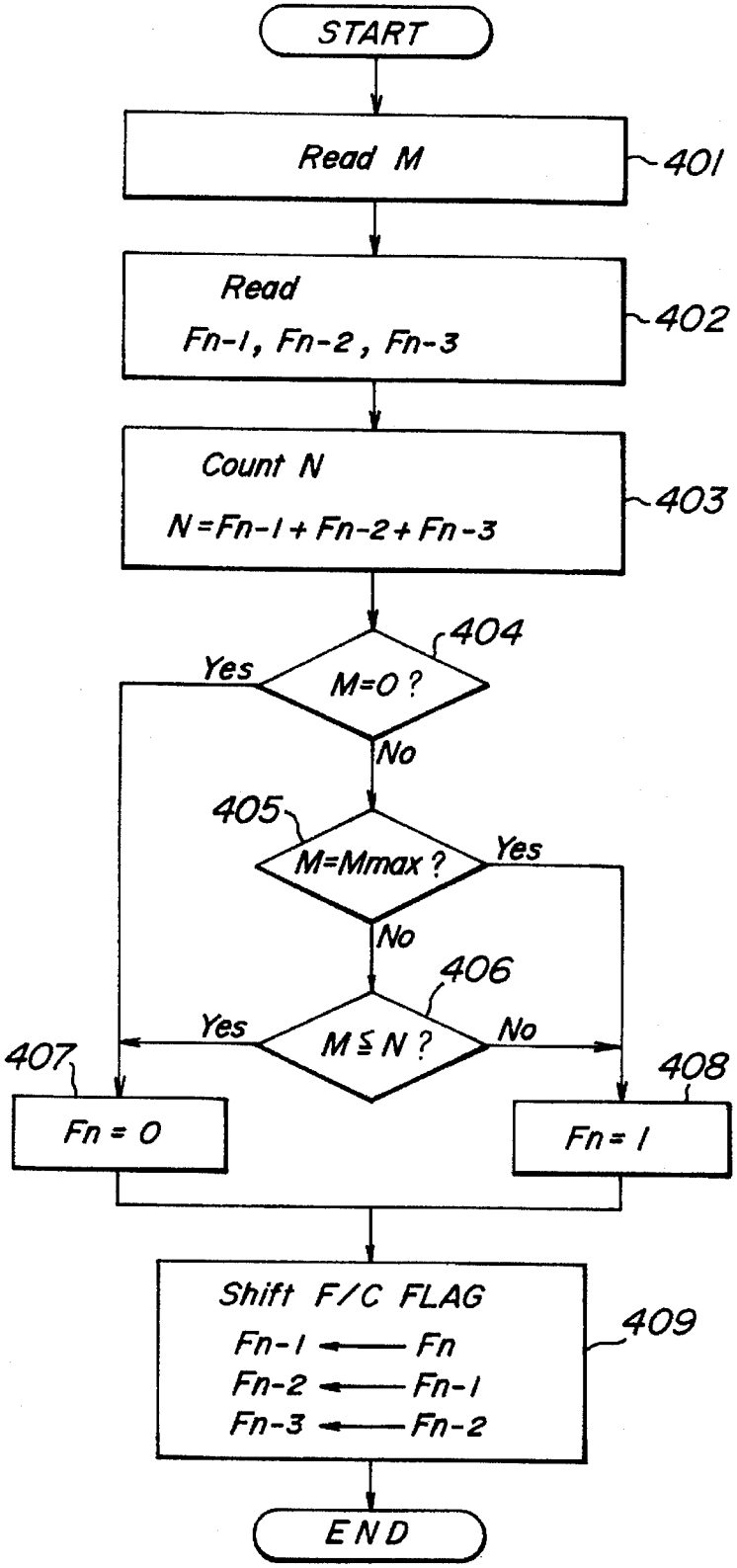
FIG. 6 is a flowchart showing one example of a control program for making judgement for an engine operational state, to be executed by the control unit in the shown embodiment.

After the limiter process through the steps 303 to 306, the mode value M within the limited range, i.e. 0 to 4 in the shown embodiment, is determined for use in execution of the control program illustrated in FIG. 6, at a step 307. As can be appreciated, the mode value is determined depending upon wheel slippage from time to time at every timing of execution of the shown routine and renewed with the most recent mode value.

FIG. 6 is a flowchart showing a routine for realizing the process corresponding to the content of the operating condition judgement portion.

The sampling period of the shown routine is different from those of the control routines of FIGS. 4 and 5, i.e. those of the wheel slippage detecting portion and the drive torque lowering magnitude commanding portion and is set to be consistent with an engine combustion cycle. Namely, the routine of FIG. 6 is adapted to be executed at every engine combustion timing. Therefore, the shown routine is executed in synchronism with the engine combustion timing and makes judgement whether F/C should be effected or not.

Initially, at a step 401, the mode value M (most recent value) determined through the step 307 in the foregoing routine of FIG. 5, is read in at every execution timing.

Then, at a step 402, the F/C flags $F_{n-1}$, $F_{n-2}$, and $F_{n-3}$ of past three cycles are read in.

As set forth above, the F/C flag is a flag for effecting the F/C when the value is 1 and maintaining the fuel supply when the value is 0.

At every time of execution of the shown routine, the value of the F/C flag is determined at a step 407 or 408, the processes of which will be discussed later, for the current loop. Then, at a step 409, the F/C flags for past three execution cycles including the currently determined one are renewed and stored.

Therefore, at the step 402, the F/C flag values at the value $F_{n-1}$ derived in the immediately preceding execution cycle, the value $F_{n-2}$ derived in the two cycle ahead and the value $F_{n-3}$ derived in the three cycle ahead are read out from a storage circuit in the control unit.

Once the F/C flag values $F_{n-1}$, $F_{n-2}$ and $F_{n-3}$ are read out, number of occurrence of F/C, namely number of F/C flags set at 1 is counted at a step 403 by:

$$N=F_{n-1}+F_{n-2}+F_{n-3} \quad (5)$$

Thus, a number N of occurrence of F/C is obtained.

As can be appreciated, the value N is variable depending upon the past hysteresis of F/C control within a range of 0 to 3.

Thus, the F/C flags for past three execution cycles are read out and occurrence of F/C within past three cycles is counted to derive the number N of occurrence of the F/C. The derived value N thus determined is used for comparison with the mode value M read out at the step 401, at a step 406 which will be discussed later.

Next, at a step 404, the mode value M is checked whether it is 0 or not. When the mode value M is 0, judgement can be made that the torque control is nor demanded. Therefore, irrespective of the number N of the occurrence of the F/C in the past, decision is made that fuel is to be supplied for the current combustion timing. Therefore, at the step 407, the F/C flag $F_n$ (current value) is reset to 0. Thereafter, the process is advanced to the step 409 to renew the storage of the F/C flags for past three cycles. Then, current process goes end.

On the other hand, when the mode value M as checked at the step 404 is not 0, process is advanced to a step 405. At the step 405, the mode value M is checked again if it is equal to the upper limit value of the mode value Mmax (Mmax=4 in the shown case). When, the mode value M as checked at the step 405 is equal to the upper limit value Mmax, judgement can be made that the possible largest torque lowering control is demanded. Therefore, in such case, decision is made that the F/C is to be effected for the current combustion timing irrespective of the number N of occurrence of the F/C. Therefore, at the step 408, the F/C flag $F_n$ for the current cycle is set to 1. Thereafter, the storage in the storage circuit of the control unit is updated with the three F/C values $F_n$, $F_{n-1}$ and $F_{n-2}$. After the process of the step 409, the process goes end.

On the other hand, when the mode value M as checked at the step 405 is not the upper limit value Mmax, the process is advanced to a step 406. At the step 406, the mode value M is compared with the number N of the occurrence of the F/C derived at the step 403 to check if the mode value M is smaller than or equal to the number N of the past occurrence of the F/C. On the basis of the result of comparison, decision is made whether the fuel is to be supplied for the current combustion timing.

Namely, when the mode value M is smaller than or equal to the number N of the past occurrence of the F/C, namely $M \leqq N$ is true, decision is made that fuel is to be supplied. On the other hand, when the mode value M is greater than the number N of the past occurrence of the F/C, namely $M \leqq N$ is false, decision is made that fuel is to be cut-off. In the former case, the processes of the steps 407 and 409 are performed for setting the F/C flag $F_n$ to 0 and storage values of the F/C flags are updated. On the other hand, in the later case, the processes of the steps 408 and 409 are performed for setting the F/C flag $F_n$ to 1 and storage values of the F/C flags are updated.

As set forth above, at every execution cycle of the shown routine, the F/C flag value $F_n$ for the current combustion timing is determined through the step 407 or 408. The F/C flag $F_n$ thus set is used in the fuel control routine of FIG. 7.

It should be noted that the F/C values $F_n$, $F_{n-1}$ and $F_{n-2}$ are stored in the storage circuit as $F_{n-1}$, $F_{n-2}$ and $F_{n-3}$ for the next execution cycle. Namely, updating of the storage in the storage circuit is performed for storing the F/C flag values derived most recent three cycles with updating the storage in the following manner.

$$F_{n-1} \leftarrow F_n \quad (6a)$$

$$F_{n-2} \leftarrow F_{n-1} \quad (6b)$$

$$F_{n-3} \leftarrow F_{n-2} \quad (6c)$$

Namely, at the step 409, the F/C flag is shifted in order as set out above at every execution cycle of the shown routine to store the F/C flag values for the most recent three cycles to get ready for next sampling. The F/C flag values thus stored in the storage circuit of the control unit is used at the steps 402 and 403 in the next execution cycle.

Figure 7:
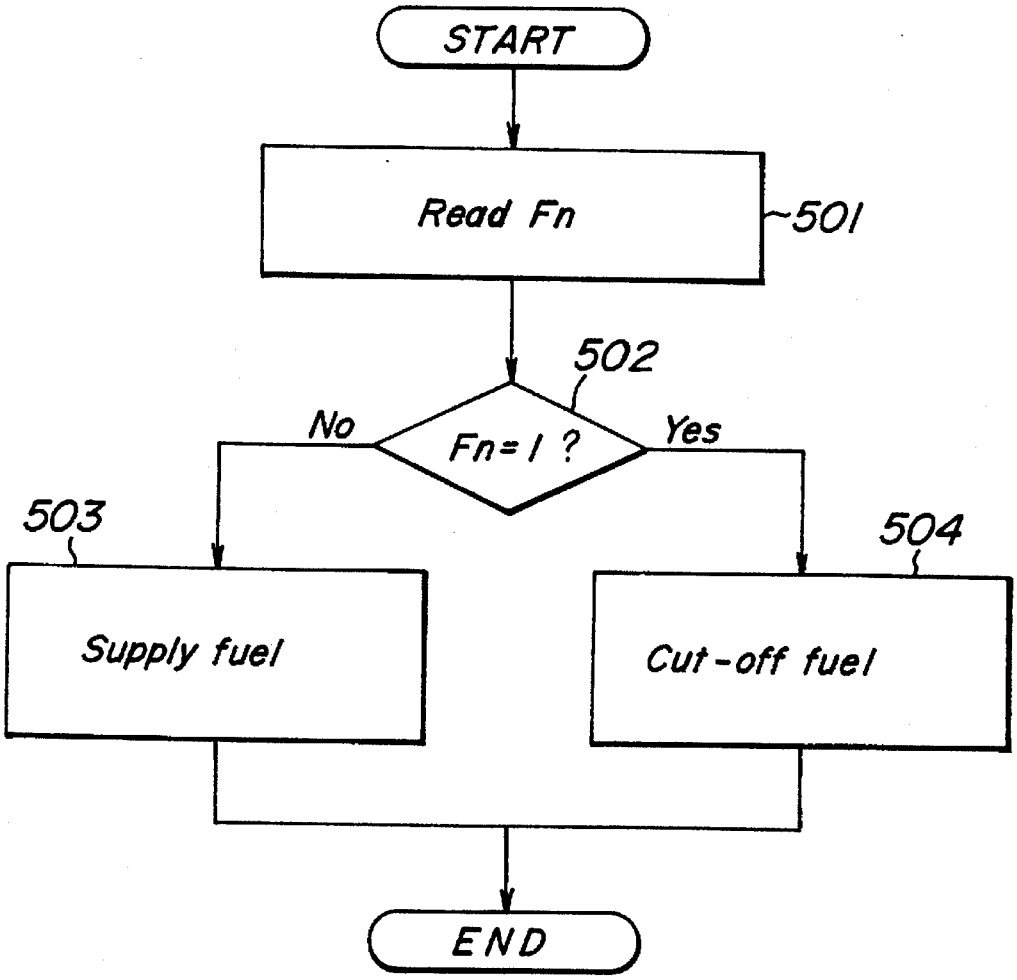
FIG. 7 is a flowchart showing one example of a control program for controlling fuel supply, to be executed by the control unit in the shown embodiment.

FIG. 7 is a flowchart showing a control routine for realizing the process in the fuel control portion. The shown routine is executed using the F/C flag $F_n$ set through the routine of FIG. 6. Namely, at the initial stage of execution of the routine of FIG. 7, the F/C flag value $F_n$ derived at the step 407 or 408 of the routine of FIG. 6 is read out (step 501). Depending upon 1 or 0 of the F/C flag value $F_n$ read out at the step 501, fuel supply or fuel cut-off is performed by the fuel supply control device 12 (steps 502, 503 and 504).

Here, in the resting cylinder slide type engine output control, the following problems may be caused when variation of assignment of the virtual cylinder number is simply performed. Namely, while the resting cylinder slide type engine output control as simply performing variable assignment of the virtual cylinder number may improve response characteristics upon initiation of the engine output torque lowering control by assigning the virtual cylinder #1 for the cylinder scheduled for next combustion, there is a room to be improved in the process fuel resumption. Considering the response characteristics upon fuel resumption, when the mode is varied in the order of 4→3→2→1 as shown in FIG. 14, for example, the F/C state is maintained during mode variation from mode 4 to mode 1 to cause delay of fuel resumption. Therefore, wasted period is caused for degrade response characteristics in fuel resumption.

Also, even with respect to the response characteristics upon initiation of the engine output control, the response characteristics can be degraded when the mode variation timing and the combustion timing are unmatched. FIG. 15 shows an example of the relationship between the mode variation and the combustion timing. When the engine output control is initiated and mode steps up as shown, combustion of #2, #3 and #4 cylinders is maintained despite of the fact that the mode is stepped up, due to late stepping up of the modes. As can be clear from FIG. 17, in the shown case, actual initiation of the engine output control can be significantly delayed.

Here, in the case where the engine output control system is employed in the traction control system for suppressing wheel spin, as in the shown embodiment, the response characteristics is particularly important.

Namely, low response characteristics at a torque down side should influence to vehicle driving stability for delay in responding to torque control demand caused at the occurrence of wheel slip due to low wheel spin stabilization performance. On the other hand, the low response characteristics at the torque resumption side should cause degradation of the vehicular acceleration characteristics.

The shown embodiment set out above provides solution for such problems in the process set forth above. Namely, according to the shown embodiment, since effect or not effect the fuel cut-off operation is determined with respect to each combustion timing irrespective of the cylinder number but with taking the history of the engine output control over a most recent given cycles, the initiation timing and termination timing of the engine output control can be precisely adapted to the current driving condition depending upon the preliminarily selected parameter, such as wheel slippage. Therefore, satisfactorily high response characteristics can be attained both at torque down side and torque resumption side control.

FIGS. 8 to 10 are timing charts showing content of control to be performed by the shown embodiment of the engine output control system according to the invention.

FIG. 8 shows the case corresponding to that of FIGS. 14(*a*) and 14(*b*). Different from the conventional resting cylinder fixed type engine output control, in which the map of FIG. 13 fixedly setting the cylinder number to be placed in resting condition, is employed, the shown embodiment of the engine output control system permits effecting of the F/C at the cylinder of any cylinder number instantly in response to initiation of the engine output control for lowering the drive torque. Namely, as shown in FIG. 8, when the mode is switched from mode 0 to mode 1 and thus the engine output control is initiated (i.e. when the mode value 1 is set through the routine of FIG. 5 and the set mode value 1 is read out in the execution of the routine of FIG. 6), the fuel cut-off operation is effected for the #4 cylinder which is scheduled for next combustion. While the mode value M is maintained at 1, the #4 cylinder, for which the fuel cut-off is initially effected, is maintained as the cylinder to be placed in resting condition.

In practice, in the routine of FIG. 6, the execution cycle at first read in the mode value M=1, M >N is satisfied since the number N of past occurrence of the F/C is 0. Therefore, the process is advanced to the step from the step 406 to the step 407 to set the F/C flag value $F_n$=1. Therefore, the F/C can be effected (FIG. 7). In the subsequent cycles for determining the mode value for other cylinders, i.e. for #1, #2 and #3 cylinders, the number N of the past occurrence of the F/C is held 1 so that M≦N is established to cause the processes through the steps 408 and 409. Therefore, fuel supply can be maintained for the cylinders #1, #2 and #3 as shown. Subsequently, the #4 cylinder is again scheduled for next combustion. At this time, the storage of the storage circuit of the control unit stores the F/C flags $F_{n-1}$, $F_{n-2}$ and $F_{n-3}$ respectively corresponding to the #1, #2 and #3 cylinders. As set forth, the F/C flags for the #1, #2 and #3 cylinders are all set to 0, the number N of the occurrence of the F/C is 0 at this stage. Since the mode value 1 is maintained, M>N is again established to perform fuel cut-off operation through the processes at the steps 407 and 409. Therefore, according to the present invention, in the aid of the routine of FIG. 6, wasting period will not be present or be minimized to provide significantly high response characteristics in initiation of the engine output control. On the other hand, since judgement whether the fuel is to be resumed or not per every execution cycle of the routine of FIG. 6, fuel resumption can be performed instantly without any delay. Therefore, the shown embodiment may improve the response characteristics both at the torque down side control and at the torque resumption side control.

FIG. 9 shows a case which corresponds to that of FIG. 13. Different from the resting cylinder slide type engine output control system in the prior proposal, the fuel cut-off can be instantly disabled in response to decreasing of the mode value M.

FIG. 10 shows a case which corresponds to that of FIG. 14. Different from the resting cylinder slide type engine output control system in the prior proposal, the fuel cut-off can be instantly initiated in response to increasing of the mode value M.

As can be appreciated, both cases are realized through the process of the routine of FIG. 6 to improve response characteristics in the torque down side control and the torque resumption side control. Therefore, high wheel spin suppression performance, vehicular driving stability and satisfactorily high acceleration characteristics can be attained.

In addition, since the shown embodiment is applicable for any number of cylinders, the shown embodiment is advantageous in view of generality in application.

Namely, while the foregoing embodiment has been discussed in terms of the application for 4-cylinder engine, it is possible to apply the shown embodiment for 6-cylinder end simply by varying the mode number (Mmax) to 6 without requiring any significant modification of the basic logic of the control. The present invention is superior in view point of such general applicability than the conventional resting cylinder fixed type engine output control system.

In the foregoing discussion, the number of modes is set to be consistent with the number of cylinders. This is advantages for the capability that fixed cylinder can be maintained in the resting state during engine output control in the same mode to maintain the other cylinders in active state constantly, in the steady state of engine output control (case of FIG. 8). However, it is not essential to make the number of modes to be consistent with the number of cylinders. Even in this case, only modification required is to change the number of modes (Mmax). This is also superior point over the conventional engine output control system.

Next, another embodiment of the engine output control system according to the present invention will be discussed with reference to FIGS. 11 and 12.

The shown embodiment is intended to perform the drive torque control by performing alternation of operation and resting, namely alternating combustion and resting per every combustion timing, in addition to split cylinder control discussed in the former embodiment.

Therefore, in the shown embodiment, the number of the modes is set at double of the number of cylinders for higher resolution and the torque variation magnitude per each step of modes is set to be half of the cylinder output capacity for higher precision in the output control.

The hardware construction of the shown embodiment may be the same as those of the former embodiment as illustrated in FIGS. 2 and 3. Also, the control programs of FIGS. 4 and 7 can be commonly used in this embodiment.

Concerning the drive torque lowering magnitude commanding portion in the shown embodiment can be formed by modifying the control program of FIG. 5 in the former embodiment in the following manner. Namely, in the process of the step 302 of FIG. 5, the gains $K_P$ and $K_I$ for computing the mode value M are set at double of the former embodiment. Also, the number of modes (Mmax) in the steps 305 and 306 are set at double (i.e. 8) of the former embodiment.

Figure 11:
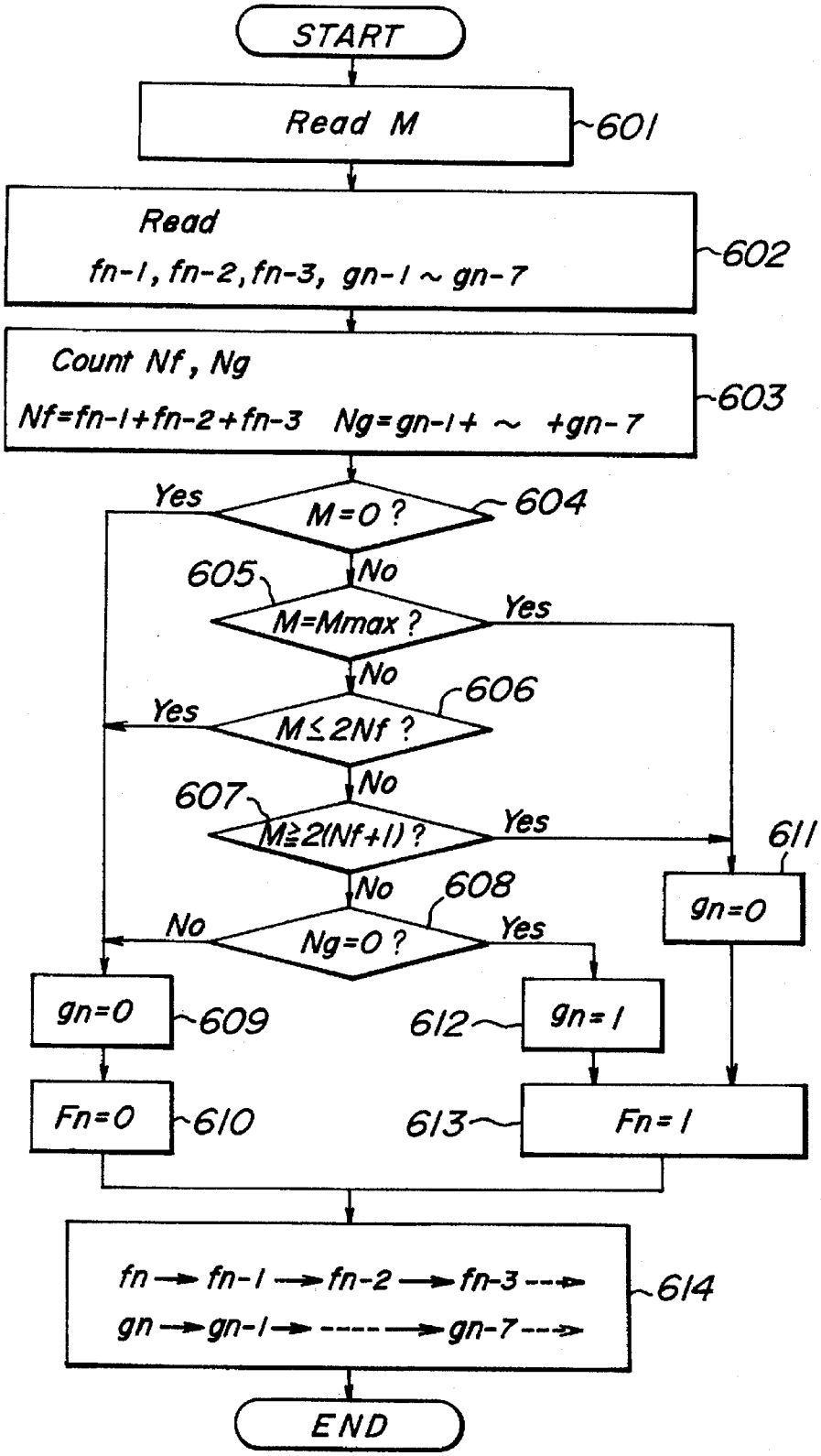
FIG. 11 is a flowchart showing one example showing a major part of a control program in another embodiment of the present invention.

FIG. 11 is a flowchart of a control program for realizing the function corresponding to the drive torque lowering magnitude commanding portion in the shown embodiment.

The process of the shown routine is basically the same as those in the former embodiment as illustrated in FIG. 6.

Similarly to the routine of FIG. 6, the mode value M is initially read out at a step 601. Subsequently, the F/C flags $f_{n-1}$, $f_{n-2}$ and $f_{n-3}$ for the most recent three cycles are read out from the storage circuit of the control unit at a step 602. In addition to this, an alternate F/C flags $g_{n-1}$~$g_{n-7}$ for most recent seven cycles are read out, at the step 602. The alternate F/C flags $g_{n-1}$~$g_{n-7}$ are additional flags employed in the shown embodiment and adapted to be used for alternately effecting fuel cut-off for every other combustion timings. Then, at a step 603, the number Nf of occurrence of the F/C is counted by:

$$Nf=f_{n-1}+f_{n-2}+f_{n-3} \quad (7)$$

Also, at the step 603, the number Ng of the occurrence of the F/C by alternate F/C flags is counted by $$Ng=g_{n-1}+g_{n-2} \ldots +g_{n-7} \quad (8)$$

Associated with this, flag shifting process for the alternate F/C flags $g_{n-1}$~$g_{n-7}$ is added in a step 614 which corresponds to the step 409 of FIG. 6 in the former embodiment. In addition, the process at a step 606 corresponding to the step 406 of FIG. 6 is modified to make judgement whether the mode value M is smaller than or equal to 2 Nf. Also, judgement of $M \geqq 2(Nf+1)$ (step 607), judgement of Ng=0 (step 608), setting of gn (current value)=0 (step 609, 611) and $g_n$ (current value)=1 (step 612) are added to the process of FIG. 6. Other processes are the same as those in FIG. 6.

As can be appreciated, the shown embodiment is only differentiated from the former embodiment in the resolution. Therefore, considering one half of the modes, it becomes the same as the former embodiment. For instance, by re-writing the step 606 to $M/2 \leqq Nf$, the process becomes the same as the former embodiment, since M/2 corresponds to M in the former embodiment. Therefore, the process content in the step 606 is substantially the same as that of 406 of FIG. 6.

Also, the process at the step 607 and subsequent steps becomes necessary due to necessity of consideration for the case of M/2=N+0.5 for twice higher resolution of mode M. Namely, when the M/2=N +0.5 is established, the process goes to the step 608.

In such case, the content to be executed as control for judgement of operating condition is to place N in number of cylinders in resting condition, and to alternately operate and rest remaining cylinders. For the cylinder designated as alternately operated and rested cylinder may be placed at resting condition once per every eight combustion timings. The alternate F/C flag $g_{n-1}$~$g_{n-7}$ are provided for this purpose in the routine of FIG. 11 so that the operating condition is judged from the flags set at most recent seven execution cycles.

FIG. 12 is a timing chart showing the content of control to be performed by the shown embodiment. In FIG. 12, there is illustrated the case of mode 3 which is intermediate between mode 2, in which fuel cut-off is to be effected for one cylinder and mode 4, in which fuel cut-off is to be effected for two cylinders. Since the mode is stepped into 3 immediately before the combustion timing of the #2 cylinder, the #2 cylinder becomes the cylinder to be permanently rested. On the other hand, the #3 cylinder is alternately operated and rested at every combustion timings. By this process, the engine output control can be performed at higher precision in comparison with the former embodiment.

As can be appreciated, the shown embodiment achieves the same effect to the former embodiment. In addition, the show embodiment permits use of substantially the same control logic to the former embodiment with achieving higher precision in torque control.

It should be appreciated that by setting the alternating schedule to 3 cycles, e.g. rest/combustion/combustion or rest/rest/combustion, the number of modes can be set to three times of the number of cylinders. Also, in the similar manner, the number of modes can be increased to be any times greater than the number of cylinders.

It should be noted that the present invention should not be limited to the shown embodiments but can be modified in various manner without departing from the scope of invention which is defined in the appended claims.

For example, although the foregoing discussion is made in terms of the engine output control by controlling fuel supply, the same effect can be obtained by controlling spark ignition solely or in combination with the fuel supply control.

According to the present invention, the output control for the internal combustion engine can be performed with taking the past operating condition per every combustion timing so that judgement whether the cylinder scheduled for next combustion is to be held in operation or to be rested independently, high response characteristics in initiation and termination of the engine output control and high flexibility can be achieved.

What is claimed is:

1. An output control system for an internal combustion engine comprising engine output lowering magnitude commanding means for outputting an engine output control command indicative of a magnitude to lower the engine output;

engine operating condition judgement means responsive to the engine output control command from the engine output lowering magnitude commanding means and active at every combustion timing, for making judgement whether the cylinder scheduled for next combustion is to be placed into the resting state or not;

cylinder resting performing means for disabling combustion at the combustion timing for which resting is determined by the engine operating condition judgement means;

storage means for storing the results of judgement made by the engine operating condition judgement means for predetermined number of immediately preceding combustion timings, said engine operating condition judgement means comparing an engine output lowering magnitude commanded by the engine output control command output by the engine output lowering magnitude commanding means and the results of past judgements stored in the storage means to make judgement whether the cylinder scheduled for next combustion is to be placed in resting condition or not on the basis of the result of comparison.

2. A system according to claim 1, wherein said system is a resting cylinder slide type output control system for a multi-cylinder internal combustion engine, and wherein said engine operating condition judgement means responds to the engine output control command from the engine output lowering magnitude commanding means, and is active at every combustion timing for making said judgement whether the cylinder scheduled for next combustion is to be placed into the resting state or not, such that the cylinder scheduled for next combustion timing is placed into the resting state responsive to an incremental magnitude to lower the engine output and into the combustion state responsive to a decremental magnitude to lower the engine output.

3. An output control system for a multi-cylinder internal combustion engine comprising:

first means for providing an engine output control command indicative of an engine output restriction magnitude;

second means active at every combustion timing, for computing the engine output restriction magnitude achieved up to the current combustion timing and making decision whether the cylinder schedules for combustion at the current combustion timing is to be placed in resting condition on the basis of the achieved engine output restriction magnitude and the engine output restriction magnitude commanded by said engine output control command;

third means for monitoring engine output restricting operation and storing data indicative of said achieved engine output restriction magnitude, said third means updating said data whenever said second means makes decision; and fourth means for controlling combustion of the cylinder scheduled for combustion at the current combustion timing depending upon the decision made by said second means.

4. A system according to claim 3, wherein said third means stores data indicative of past decisions over a predetermined number of most recent combustion timings as said data indicative of the achieved engine output restriction magnitude.

5. A system according to claim 4, wherein said second means reads out the data stored in said third means, calculating the number of cylinders placed in the resting condition in said predetermined number of most recent combustion timings and the number of cylinders to be placed in the resting condition on the basis of the required engine output restriction magnitude commanded by said engine output control command, and comparing the number of cylinders placed in the resting condition and the number of cylinders to be placed in the resting conditions for making decision to place the cylinder scheduled for combustion at the current combustion timing in the resting condition when the number of cylinders to be placed in the resting condition is greater than the number of cylinders placed in the resting condition.

6. A system according to claim 5, wherein said predetermined number of most recent combustion timings is set at least a value derived by subtracting one from the number of cylinders in the internal combustion engine.

7. A system according to claim 3, wherein said second means makes decision to selectively place the cylinder scheduled for combustion in the current combustion timing into a first engine output restriction mode position to be permanently placed in resting condition as long as the engine output control command of said first means is held unchanged and into a second engine output restriction mode position to varying state between resting condition and active condition according to a predetermined switching schedule, and a third engine output restriction mode position to be permanently placed in active condition as long as the engine output command of the first means is held unchanged.

8. A system according to claim 3, wherein said system is a resting cylinder slide type output control system for a multi-cylinder internal combustion engine, and wherein said second means is active at every combustion timing for computing the engine output restriction magnitude and for making said decision whether the cylinder schedules for combustion at the current combustion timing is to be placed in resting condition such that the cylinder scheduled for next combustion timing is placed into the resting state responsive to an incremental magnitude to lower the engine output and into the combustion state responsive to a decremental magnitude to lower the engine output.

9. A traction control system comprising:

first means for monitoring wheel slippage at driving wheel on the basis of wheel speeds at respective wheels;

second means for providing an engine output control command indicative of an engine output restriction magnitude;

third means active at every combustion timing, for computing the engine output restriction magnitude achieved up to the current combustion timing and making decision whether the cylinder schedules for combustion at the current combustion timing is to be placed in resting condition on the basis of the achieved engine output restriction magnitude and the engine output restriction magnitude commanded by said engine output control command;

fourth means for monitoring engine output restricting operation and storing data indicative of said achieved engine output restriction magnitude, said fourth means updating said data whenever said second means makes decision; and fifth means for controlling combustion of the cylinder scheduled for combustion at the current combustion timing depending upon the decision made by said third means.

10. A system according to claim 9, wherein said fourth means stores data indicative of past decisions over a predetermined number of most recent combustion timings as said data indicative of the achieved engine output restriction magnitude.

11. A system according to claim 10, wherein said third means reads out the data stored in said fourth means, calculating the number of cylinders placed in the resting condition in said predetermined number of most recent combustion timings and the number of cylinders to be placed in the resting condition on the basis of the required engine output restriction magnitude commanded by said engine output control command, and comparing the number of cylinders placed in the resting condition and the number of cylinders to be placed in the resting conditions for making decision to place the cylinder scheduled for combustion at the current combustion timing in the resting condition when the number of cylinders to be placed in the resting condition is greater than the number of cylinders placed in the resting condition.

12. A system according to claim 11, wherein said predetermined number of most recent combustion timings is set at least a value derived by subtracting one from the number of cylinders in the internal combustion engine.

13. A system according to claim 9, wherein said third means makes decision to selectively place the cylinder scheduled for combustion in the current combustion timing into a first engine output restriction mode position to be permanently placed in resting condition as long as the engine output control command of said second means is held unchanged and into a second engine output restriction mode position to varying state between resting condition and active condition according to a predetermined switching schedule, and a third engine output restriction mode position to be permanently placed in active condition as long as the engine output command of the second means is held unchanged.

14. A traction control system according to claim 9, including a resting cylinder slide type output control system for a multi-cylinder internal combustion engine, wherein said third means computes the engine output restriction magnitude achieved up to the current combustion timing and makes said decision whether the cylinder schedules for combustion at the current combustion timing is to be placed in resting condition, such that the cylinder scheduled for next combustion timing is placed into the resting state responsive to an incremental magnitude to lower the engine output, and into the combustion state responsive to a decremental magnitude to lower the engine output.

15. An output control system for an internal combustion engine having a plurality of cylinders comprising engine output lowering magnitude commanding means for outputting an engine output control command indicative of a magnitude to lower the output the engine having a plurality of cylinders;

calculation means for calculating number of cylinders to be placed in resting condition on the basis of the commanded engine output lowering magnitude;

engine operating condition judgement means for making judgement whether the cylinder scheduled for next combustion is to be placed into the resting state or not on the basis of the number of cylinders to be placed in resting condition calculated by said calculation means;

cylinder resting performing means for disabling combustion at the combustion timing for which resting is determined by the engine operating condition judgement means;

storage means for storing the results of judgement made by the engine operating condition judgement means for predetermined number of immediately preceding combustion timings, which predetermined number is at least a value subtracting one from the number of the cylinders, said engine operating condition judgement means comparing the number of cylinders to be placed in resting condition calculated by said calculation means and the number of cylinders placed in resting condition in preceding combustion timings, to make judgement whether the cylinder scheduled for next combustion is to be placed in resting condition or not on the basis of the result of comparison.

16. A system according to claim 15, wherein said system is a resting cylinder slide type output control system for a multi-cylinder internal combustion engine, and wherein said engine operating condition judgement means makes said judgement, as to whether the cylinder scheduled for next combustion is to be placed into the resting state or not, such that the cylinder scheduled for next combustion timing is placed into the resting state responsive to an incremental magnitude to lower the engine output, and into the combustion state responsive to a decremental magnitude to lower the engine output.

* * * * *